US008661946B2

(12) United States Patent
Lee et al.

(10) Patent No.: US 8,661,946 B2
(45) Date of Patent: Mar. 4, 2014

(54) RATCHET WRENCH

(76) Inventors: Tsan-Chang Lee, Taichung (TW); Yueh-Li Wang, Taichung (TW)

( * ) Notice: Subject to any disclaimer, the term of this patent is extended or adjusted under 35 U.S.C. 154(b) by 295 days.

(21) Appl. No.: 13/196,848

(22) Filed: Aug. 2, 2011

(65) Prior Publication Data

US 2013/0032008 A1 Feb. 7, 2013

(51) Int. Cl.
*B25B 13/46* (2006.01)

(52) U.S. Cl.
USPC ..... 81/60

(58) Field of Classification Search
USPC ..... 81/60–63.2
See application file for complete search history.

(56) References Cited

U.S. PATENT DOCUMENTS

| | | | | |
|---|---|---|---|---|
| 6,044,731 | A * | 4/2000 | Hsieh | 81/60 |
| 6,862,955 | B1 * | 3/2005 | Shu-Sui et al. | 81/60 |
| 7,100,477 | B2 * | 9/2006 | Lee | 81/60 |
| 7,444,903 | B1 * | 11/2008 | Li | 81/60 |
| 2003/0213342 | A1 * | 11/2003 | Wu | 81/60 |

* cited by examiner

*Primary Examiner* — Hadi Shakeri

(57) ABSTRACT

A ratchet wrench includes first recess in the function end thereof and a second recess is defined in the inside of the first recess. A ratchet wheel is located in the first recess, and a pawl and a resilient member are located in the second recess. The resilient member is connected between the pawl and the inside of the second recess. The resilient member biases the pawl to be engaged with the ratchet wheel. A C-shaped restriction member is engaged with the first recess and has a rod which is inserted into the second recess. A space is defined between the inside of the first recess and the rod. The second end of the resilient member is located in the space so as to position the resilient member in the second recess.

10 Claims, 8 Drawing Sheets

RATCHET WRENCH

FIELD OF THE INVENTION

The present invention relates to a wrench, and more particularly, to a ratchet wrench functioned at one direction.

BACKGROUND OF THE INVENTION

A conventional ratchet wrench 70 is shown in FIGS. 10 to 12 and generally includes a first recess 71 defined in the function end of the wrench 70 and a second recess 72 is defined radially in the inside of the first recess 71. Two flanges 73, 74 extend inward from the inside of the first recess 71, wherein the flange 73 includes a positioning groove 730 defined centrally therein. A first groove 75 and a second groove 76 are respectively defined between the conjunction portions of the first recess 71 and the two flanges 73, 74. The first and second grooves 75, 76 are partially and respectively in communication with the second recess 72. A ratchet wheel 71 is located in the first recess 71, and the second recess 72 accommodates a pawl and a spring which biases the pawl to be engaged with the ratchet wheel. When manufacturing the wrench 70, surplus material is formed at the conjunction portions between the first recess 71 and the first and second flanges 73, 74, so that the ratchet wheel cannot be smoothly operated. The first and second grooves 75, 76 are therefore made to remove the surplus material.

U.S. Pat. No. 7,044,029 discloses a wrench wherein the first recess has a groove defined in the mediate portion thereof and a C-clip is engaged with the groove. The C-clip has a rod extending perpendicularly to the axis of the first recess so that the spring has one end mounted to the rod and the other end of the spring contacts the pawl. However, the groove has to be made by further machining process which increases the manufacturing cost, and there are two further grooves have to be made in the inside of the first recess so as to remove the surplus material. In other words, there are three grooves defined in the inside of the first recess. Generally, the thickness of the function end of the wrench is 10 mm and the depth of the first recess is 6 mm. Three grooves have to be made within the 6 mm thickness of the inside of the first recess and this definitely reduces the structure strength of the function end. For a smaller scale wrench, the function end is less than 8 mm and the depth of the first recess is only 4 mm. Each groove requires 1 mm so that it is difficult to make three grooves in the 4 mm thickness of the inside of the first recess. The C-clip is located in the first recess and faces the wrench wheel, the C-clip is narrower and moves inward after a period of use, the C-clip directly contacts the ratchet teeth of the ratchet wheel and affects the operation of the ratchet wheel. The spring has to be mounted to the rod of the C-clip and this assembling step is difficult in the small space in the first recess. Furthermore, the spring has to be made to have a ring to be mounted to the rod, and this increases the manufacturing cost to the spring.

The present invention intends to provide a wrench which is easily manufactured and assembled.

SUMMARY OF THE INVENTION

The present invention relates to a ratchet wrench and comprises a first recess defined in the function end thereof and a second recess is defined in the inside of the first recess. A ratchet wheel is located in the first recess, and a pawl and a resilient member are located in the second recess. The resilient member is connected between the pawl and the inside of the second recess. The resilient member biases the pawl to be engaged with the ratchet wheel. A C-shaped restriction member is engaged with the first recess and has a rod which is inserted into the second recess. A space is defined between the inside of the first recess and the rod. The second end of the resilient member is located in the space so as to position the resilient member in the second recess.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
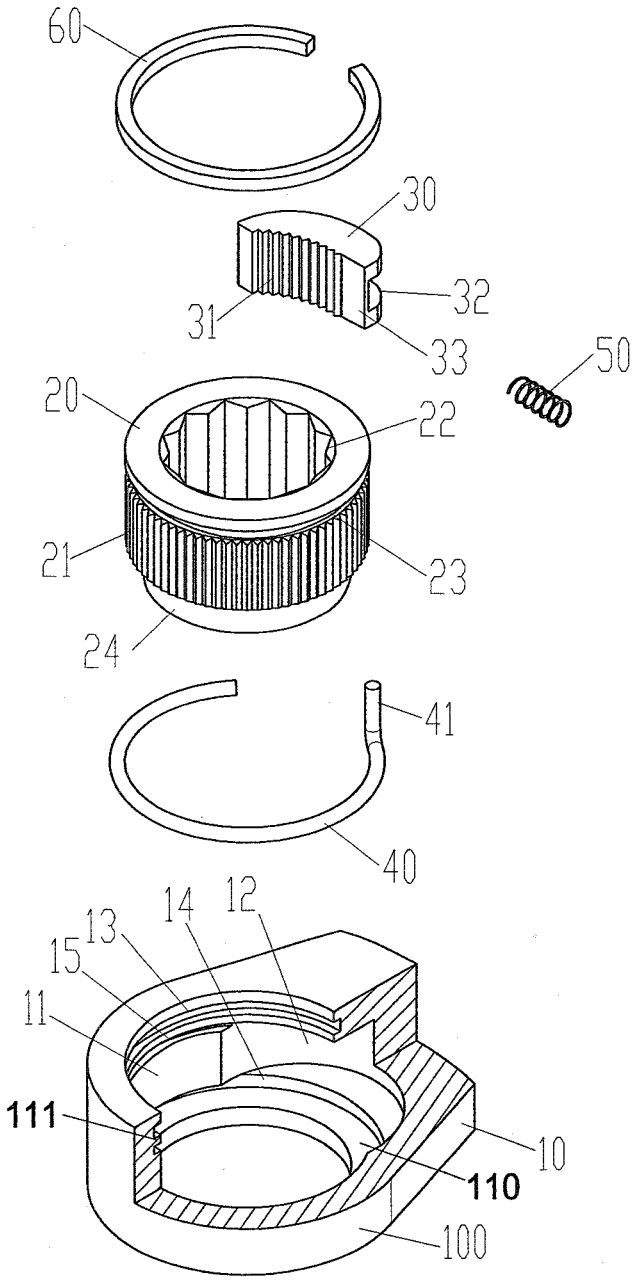
FIG. 1 is an exploded view to show the ratchet wrench of the present invention.
Figure 2:
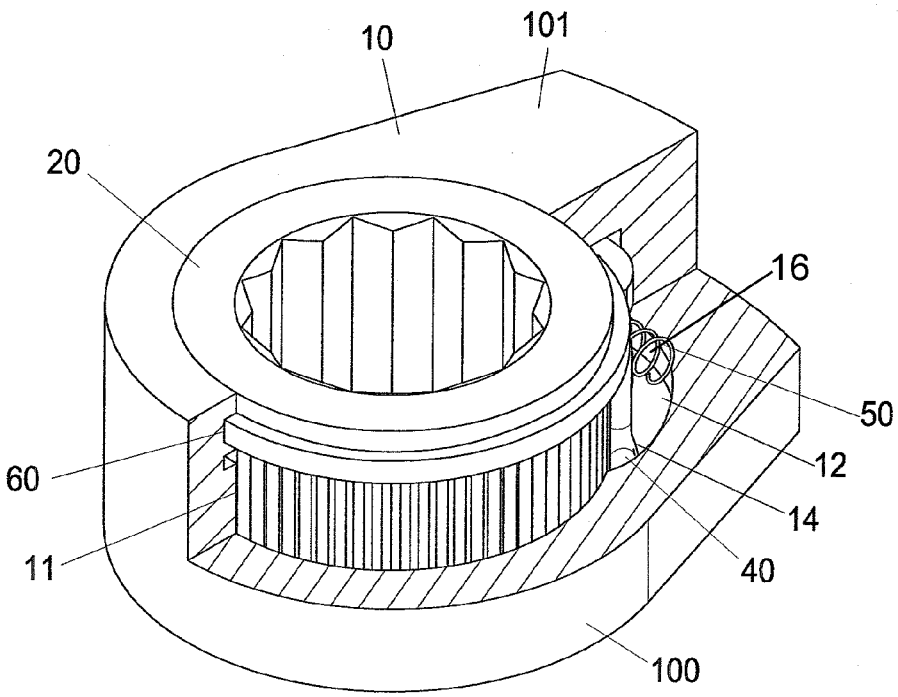
FIG. 2 is a perspective view to show the ratchet wrench, partly removed, of the present invention.
Figure 3:
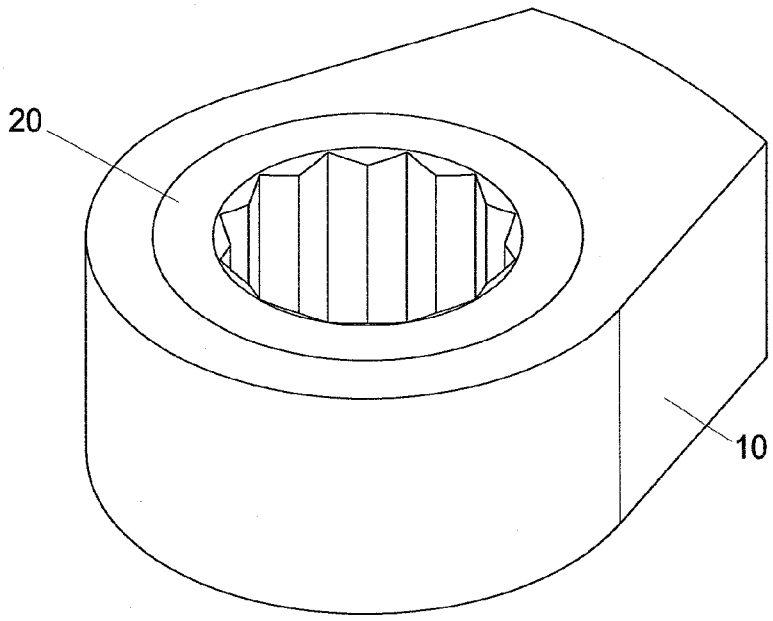
FIG. 3 is a perspective view to show the ratchet wrench of the present invention.

Referring to FIGS. 1 to 3, the ratchet wrench 10 of the present invention comprises a function end 100 and a handle 101 is connected to the function end 100. The function end 100 has a circular first recess 11 and a second recess 12 is defined in the inside of the first recess 11. The center of the second recess 12 is located within the first recess 11 and the diameter of the second recess 12 is smaller than that of the first recess 11. Two flanges 110, 111 respectively extend inward from the inside of the first recess 11. The first and second recesses 11, 12 are in communication with each other. The flange 111 includes a first positioning groove 13 defined in the mediate portion thereof. A first groove 14 and a second groove 15 are respectively defined in the conjunction portions between the inside of the first recess 11 and the two flanges 110, 111 so as to remove the surplus material. The first and second grooves 14, 15 communicate with the second recess 12.

A ratchet wheel 20 is located in the first recess 11 and includes ratchet teeth 21 define in the outside of the mediate portion thereof. An engaging recess 22 is defined in a top of the ratchet wheel 20 and is a polygonal recess so as to be engaged with an object. A second positioning groove 23 is defined in the outside of a top portion of the ratchet wheel 20 and is located corresponding to the first positioning groove 13. A contact portion 24 extends from the bottom of the ratchet wheel 20 and is engaged with the inside of the flange 110.

A pawl 30 and a resilient member 50 are located in the second recess 12. The pawl 30 includes ratchet teeth 31 defined in the mediate portion of the front side thereof and a smooth plain surface 33 is formed on an end of the front side of the pawl 30. The ratchet teeth 31 of the pawl 30 are engaged with the ratchet teeth 21 of the ratchet wheel 20. A connection portion 32 is a slot and defined in the rear side of the pawl 30.

A flexible C-shaped restriction member 40 located within the first recess 11 and a diameter of the restriction member 40 is larger than that of the first groove 14 so that when the restriction member 40 is engaged with the first groove 14, an outward tension is generated from the restriction member 40. The restriction member 40 is located corresponding to the contact portion 24. The restriction member 40 has a rod 41 extending along a direction parallel to the axis of the second recess 12 and the rod 41 is inserted into the second recess 12. A space 16 is defined between the inside of the second recess 12 and the rod 41, the second end of the resilient member 50 is located in the space 16 and positioned in the second recess 12. The rod 41 is perpendicular to the restriction member 40 and a height of the rod 41 is longer than a depth of the second recess 12.

The resilient member 50 has a first end contacting the pawl 30 and a second end of the resilient member 50 contacts the inside of the second recess 12. The resilient member 50 biases the ratchet teeth 31 of the pawl 30 to be engaged with ratchet teeth 21 of the ratchet wheel 20. The resilient member 50 is restricted between the plain surface 33 and the rod 41 so that the resilient member 50 does not disengage from the second recess 12.

A positioning member 60 is engaged with the first and second positioning grooves 13, 23 so as to position the ratchet wheel 20 in the first recess 11.

Figure 5:
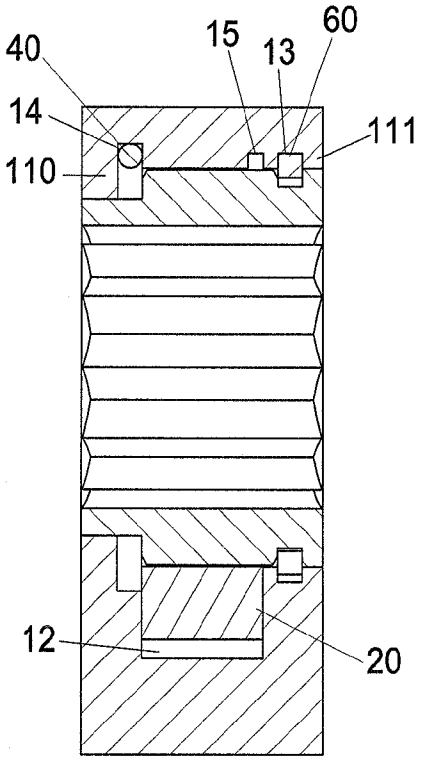
FIG. 5 is a cross sectional view, taken along line A-A in FIG. 4.
Figure 4:
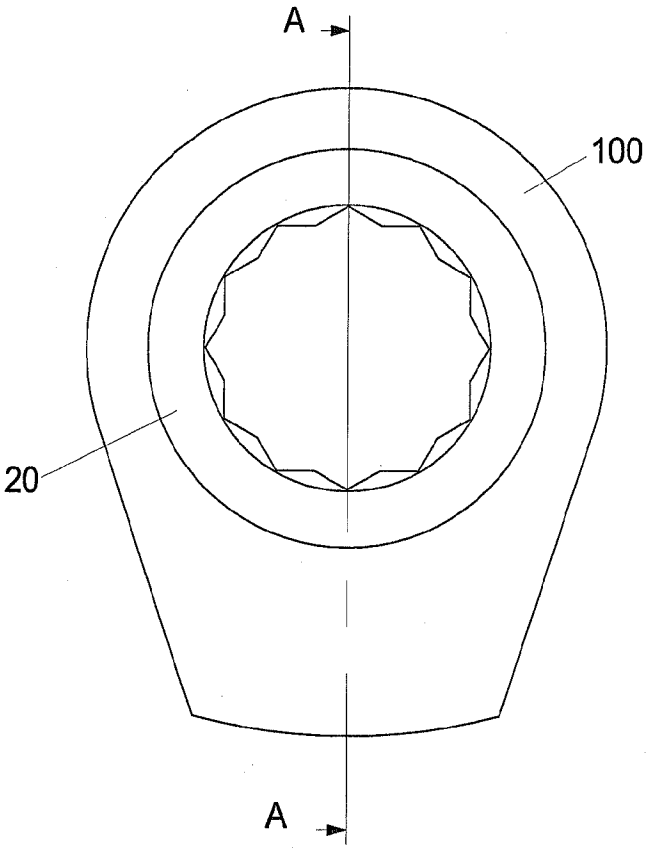
FIG. 4 is a top view of the ratchet wrench of the present invention.

As shown in FIGS. 4 and 5, the ratchet wheel 20 is rotatably located in the first recess 11 and the contact portion 24 partially extends through the inside of the flange 110. The pawl 30 is located in the second recess 12. The first end of the resilient member 50 is engaged with the connection portion 32 of the pawl 30.

Figure 7:
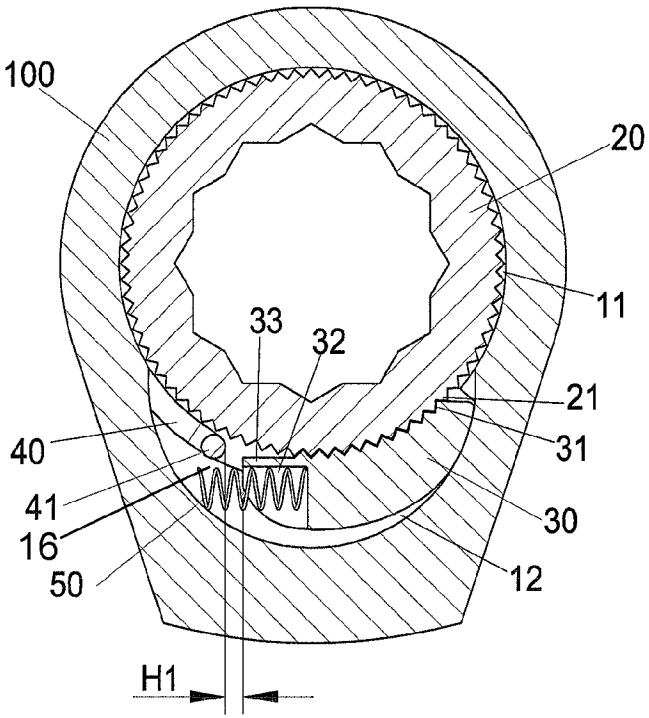
FIG. 7 is a cross sectional view, taken along line B-B in FIG. 6.
Figure 6:
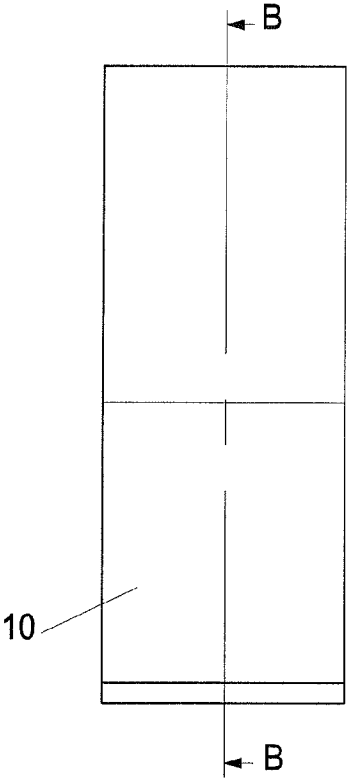
FIG. 6 is a side view of the ratchet wrench of the present invention.

As shown in FIGS. 6 and 7, the first end of the resilient member 50 is engaged with the connection portion 32 of the pawl 30 and the second end of the resilient member 50 contacts the inside of the second recess 12 so as to engage the first and second ratchet teeth 31, 21. The distance H1 between the rod 41 and a distal end of the plain surface 33 is larger than the distance that the pawl 30 moves between a position where the ratchet teeth 31 of the pawl 30 are engaged with the ratchet teeth 21 of the ratchet wheel 20 and a position where the ratchet teeth 31 of the pawl 30 are disengaged from the ratchet teeth 21 of the ratchet wheel 20.

Figure 8:
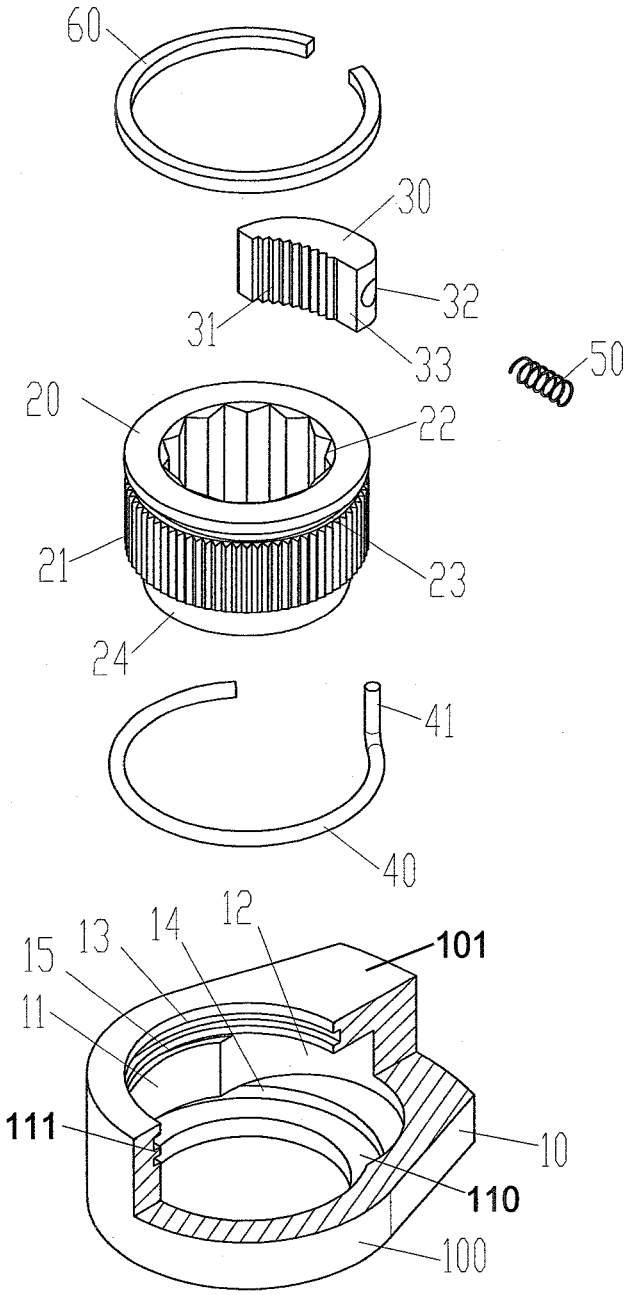
FIG. 8 is an exploded view to show the second embodiment of the ratchet wrench of the present invention.

As shown in FIG. 8 which shows the second embodiment of the present invention wherein the connection portion 32 is a circular hole and the inner diameter of the connection portion 32 accommodates the outer diameter of the resilient member 50.

Figure 9:
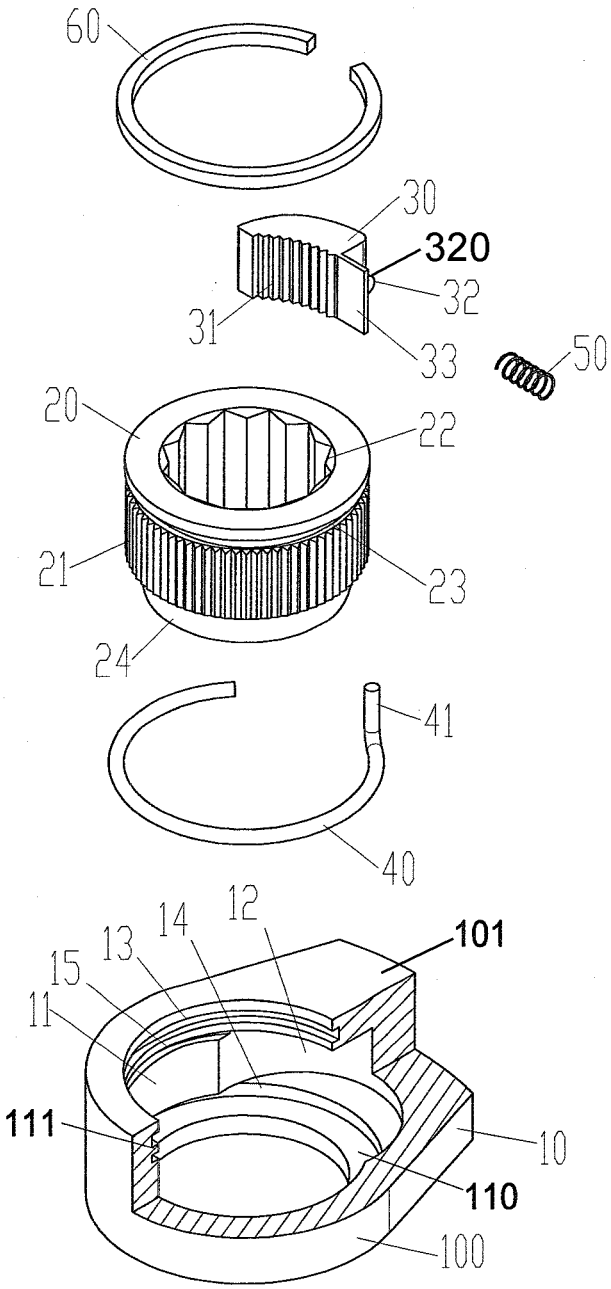
FIG. 9 is a perspective view to show the third embodiment of the ratchet wrench of the present invention.
Figure 10:
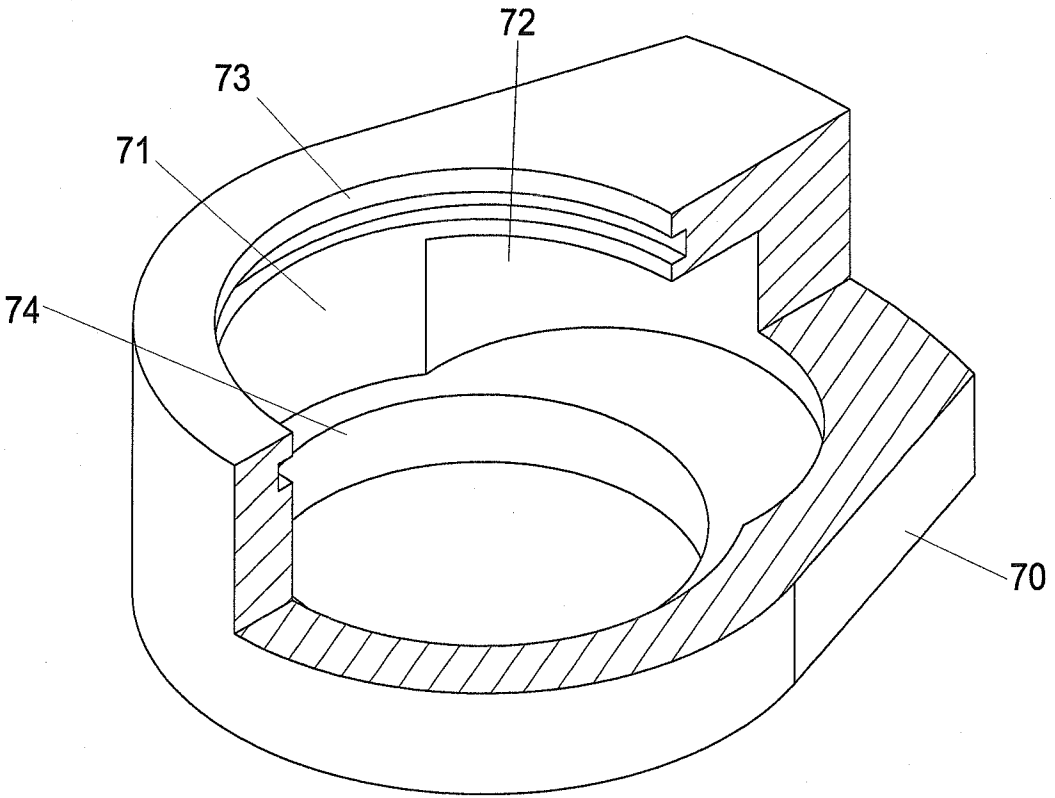
Prior Art FIG.10
FIG. 10 is a perspective view of the conventional ratchet wrench.
Figure 12:
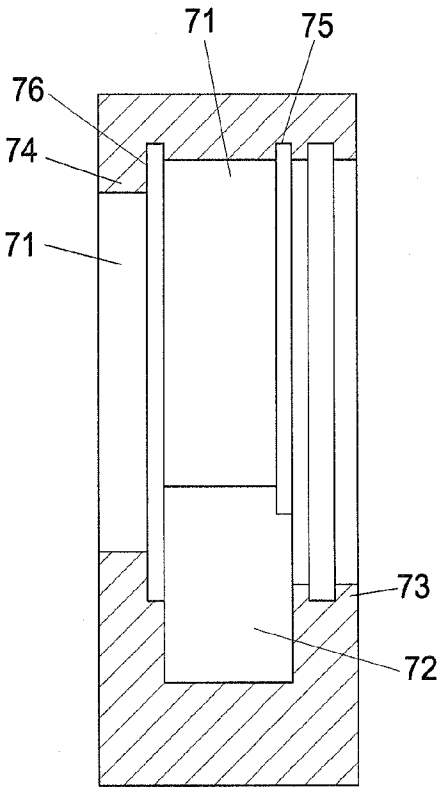
Prior Art FIG.12
FIG. 12 is a cross sectional view, taken along line A-A in FIG. 11.
Figure 11:
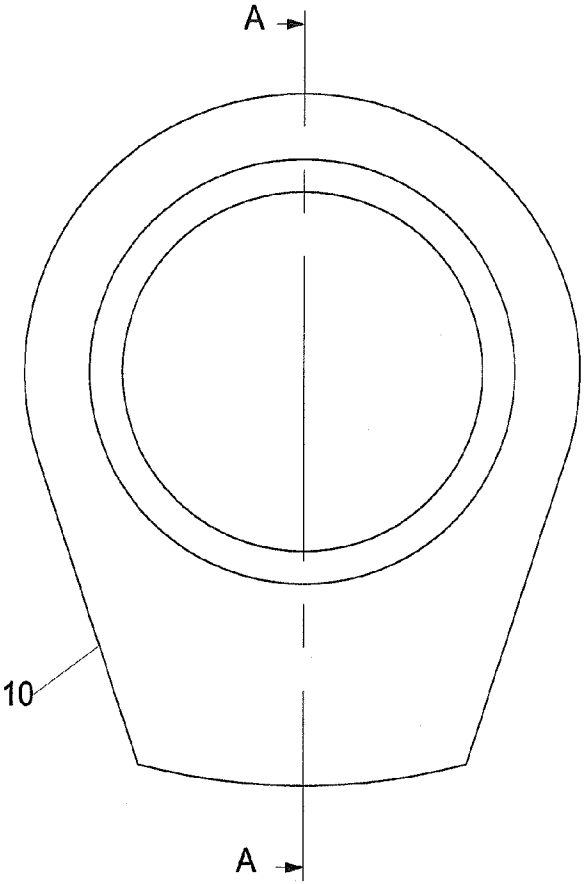
Prior Art FIG.11
FIG. 11 is a top view of the conventional ratchet wrench.

As shown in FIG. 9 which shows the second embodiment of the present invention wherein the connection portion 32 includes a protrusion 320 and the resilient member 50 is mounted to the protrusion 320.

The present invention uses the first and second grooves to position the restriction member 40 and the resilient member 50, and this does not need to machine four grooves as mentioned in the prior art. The restriction member 40 is engaged with the grooves and located corresponding to the smooth contact portion 24 so that when the restriction member 40 fatigues, it does not wear out the ratchet teeth 21. The restriction member 40 is engaged with the grooves and the resilient member 50 is located in the second recess 12. The resilient member 50 is biased between the pawl 30 and the space 16, the assembling steps are easy. The resilient member 50 is restricted by the space 16 and does not need to make a ring so that it can be made at low cost. A resilient member rather than a spring can also be used. The plain surface 33 of the pawl 30 stops the resilient member 50, so that when the ratchet wheel 20 moves backward, the resilient member 50 is compressed and bent toward the inside of the second recess 12, the resilient member 50 does not contact the ratchet teeth 21.

While we have shown and described the embodiment in accordance with the present invention, it should be clear to those skilled in the art that further embodiments may be made without departing from the scope of the present invention.

What is claimed is:

1. A ratchet wrench comprising:

a function end and a handle connected to the function end, the function end having a circular first recess and a second recess defined in an inside of the first recess, a ratchet wheel located in the first recess, a pawl and a resilient member located in the second recess, a first end of the resilient member contacting the pawl and a second end of the resilient member contacting an inside of the second recess, the resilient member biasing ratchet teeth of the pawl to be engaged with ratchet teeth of the ratchet wheel, a C-shaped restriction member engaged with the first recess and having a rod which extends along a direction of an axis of the second recess and is inserted into the second recess, a space defined between the inside of the second recess and the rod, the second end of the resilient member located in the space and positioned in the second recess, wherein the pawl includes a plain surface on an end thereof and a distance between the rod and a distal end of the plain surface is larger than a distance that the pawl moves between a position where the ratchet teeth of the pawl are engaged with the ratchet teeth of the ratchet wheel and a position where the ratchet teeth of the pawl are disengaged from the ratchet teeth of the ratchet wheel.

2. The ratchet wrench as claimed in claim 1, wherein a first flange extends inward from the inside of the first recess and a first groove is defined between a conjunction portion of the first flange and the inside of the first recess, the first groove is partially communication with the second recess, the restriction member is engaged with the first groove.

3. The ratchet wrench as claimed in claim 2, wherein a diameter of the restriction member is larger than that of the first groove so that when the restriction member is engaged with the first groove, an outward tension is generated from the restriction member.

4. The ratchet wrench as claimed in claim 1, wherein the rod is perpendicular to the restriction member and a height of the rod is longer than a depth of the second recess.

5. The ratchet wrench as claimed in claim 1, wherein the rod extends along a direction parallel to the axis of the second recess.

6. The ratchet wrench as claimed in claim 1, wherein the pawl includes the ratchet teeth located at a central portion of a front side thereof and a smooth plain surface is defined in the front side of an end of the pawl, a connection portion is defined in a rear side of the pawl.

7. The ratchet wrench as claimed in claim 6, wherein the connection portion is a circular hole and an inner diameter of the connection portion accommodates an outer diameter of the resilient member.

8. The ratchet wrench as claimed in claim 6, wherein the connection portion includes a protrusion and the resilient member is mounted to the protrusion.

9. The ratchet wrench as claimed in claim 1, wherein the ratchet wheel includes an engaging recess which is a polygonal recess.

10. The ratchet wrench as claimed in claim 1, wherein the pawl includes the ratchet teeth located at a central portion of a front side thereof and a smooth plain surface is defined in the front side of an end of the pawl, a connection portion is a slot and defined in a rear side of the pawl.

* * * * *